US005233126A

United States Patent [19]

Vogt et al.

[11] Patent Number: 5,233,126

[45] Date of Patent: Aug. 3, 1993

[54] DECELERATION DEVICE FOR A SUBMUNITION UNIT WITH TEXTILE PACKAGE FOR DECELERATION ELEMENT

[75] Inventors: Klaus-Dietmar Karius, Jüchen, all of Fed. Rep. of Germany
Klaus-Dietmar Karius, J/e,uml/u/chen, all of Fed. Rep. of Germany

[73] Assignee: Rheinmetall GmbH, Dusseldorf, Fed. Rep. of Germany

[21] Appl. No.: 898,531

[22] Filed: Jun. 15, 1992

[30] Foreign Application Priority Data

Jun. 20, 1991 [DE] Fed. Rep. of Germany ..... 4120339

[51] Int. Cl.[5] ..... F42B 10/56

[52] U.S. Cl. ..... 102/386; 102/339; 102/393; 102/489; 244/149; 244/150

[58] Field of Search ..... 102/337, 339, 340, 348, 102/354, 386–388, 393, 476, 489; 244/147–150

[56] References Cited

U.S. PATENT DOCUMENTS 3,713,387 1/1973 Karp ..... 102/387
4,693,436 9/1987 Gold et al. ..... 244/149
4,856,432 8/1989 Synofzik .
5,054,398 10/1991 Dobler et al. ..... 102/387

FOREIGN PATENT DOCUMENTS 69934 4/1927 Sweden ..... 244/149
337251 10/1930 United Kingdom ..... 244/148

*Primary Examiner*—Harold J. Tudor
*Attorney, Agent, or Firm*—Spencer, Frank & Schneider

[57] ABSTRACT

A deceleration device for a submunition unit ejectable from a spin stabilized carrier projectile includes a deployable deceleration element. The deceleration element is packaged in textile package including an essentially circular disc, at least three straps connected and arranged radially to the disc, with each strap having a free end and provided with a loop and a closing line received through the loops for pulling the loops together to close the package about the deceleration element. An activation line is connected to the closing line and held by the textile package for releasing the closing line for allowing the package to open for deployment of the deceleration element after the activation line is released from the package by being stretched in a controlled manner.

6 Claims, 3 Drawing Sheets

DECELERATION DEVICE FOR A SUBMUNITION UNIT WITH TEXTILE PACKAGE FOR DECELERATION ELEMENT

BACKGROUND OF THE INVENTION

The present invention relates to a deceleration device for submunition units that can be ejected from a spin stabilized carrier projectile and which includes a deployable deceleration element.

European Patent Application EP-A 0,274,580 and corresponding U.S. Pat. No. 4,856,432 disclose a submunition unit provided with a deceleration element made of a fabric or plastic sheet in the shape of a disc and which is provided with a supporting structure of radial and crisscrossing strips of webbing and a hem facing tape. The deceleration element is accommodated in a ring element that can be separated from the submunition unit and deployment is effected by the rotation.

It is desirable to effect the activation of the deceleration device in a submunition unit in a controlled manner and in time after the performance of certain functional steps. To accomplish this, however, it is necessary to prevent the deceleration device from being deployed for a certain length of time under heavy spinning, independently of the structural space, and to then permit it to open in a controlled manner. This is not possible with the prior art deceleration device.

SUMMARY OF THE INVENTION

It is an object of the present invention to provide a deceleration device of the type first described above which is reliably prevented from deploying for a certain period of time under heavy spinning, independently of the structural space, and then opens in a controlled manner.

The above and other objects are accomplished according to the invention in the context of a deceleration device for a submunition unit that can be ejected from a spin stabilized carrier projectile, with the deceleration device including a deployable deceleration element, wherein, there is additionally provided a textile package for packaging the deceleration element in the deceleration device, comprising: an essentially circular disc; at least three straps connected and arranged radially to the disc, each strap having a free end and a loop provided at the free end; and a closing line received through the loops for pulling the loops together to close the package about the deceleration element; and an activation line connected to the closing line and held by the textile package for releasing the closing line for allowing the package to open for deployment of the deceleration element after the activation line is released from the textile package by being stretched in a controlled manner.

Further features of the invention can be found in the description below.

The invention will now be described in greater detail with reference to an embodiment thereof that is illustrated in the attached drawing figures.

DETAILED DESCRIPTION OF PREFERRED EMBODIMENTS

Figure 1:
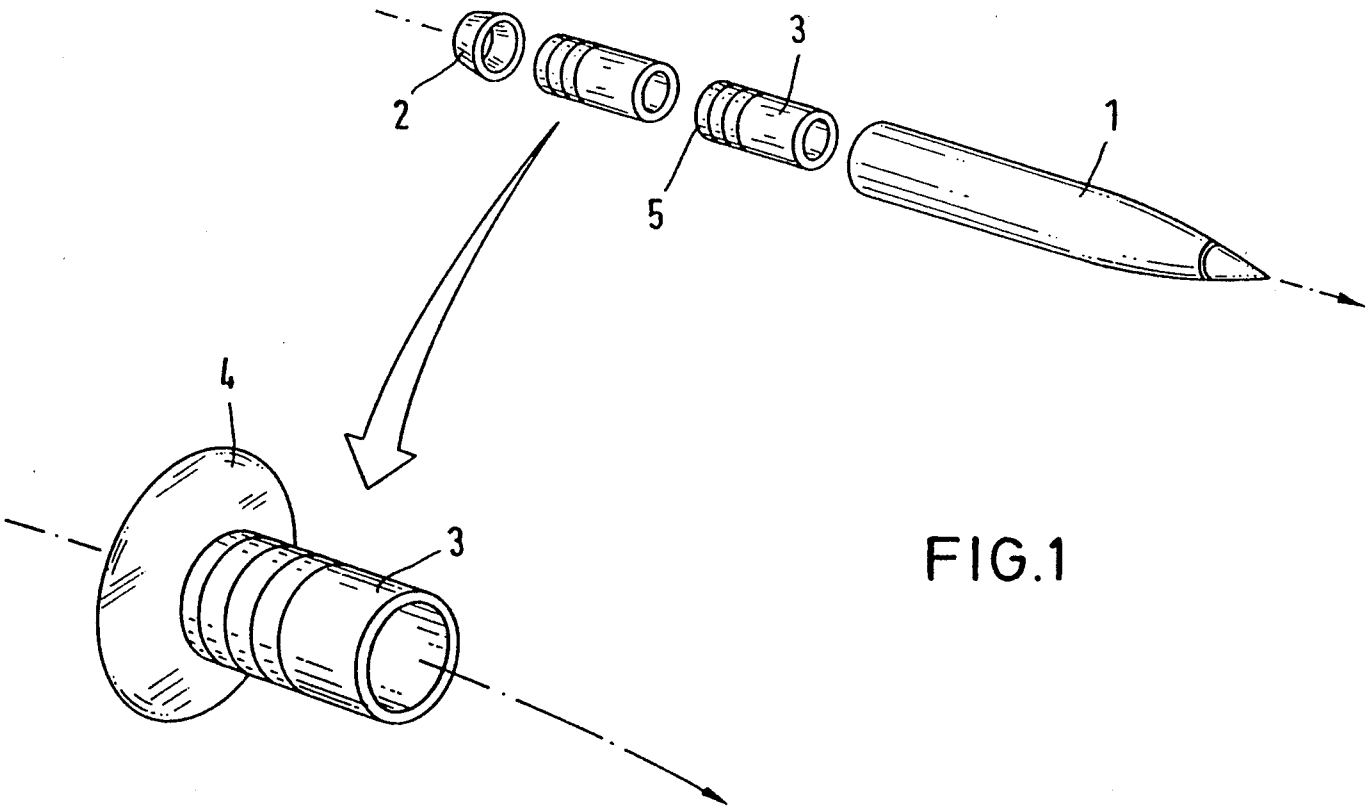
FIG. 1 is a schematic showing a perspective view of a carrier projectile with ejected submunition units.

Referring to FIG. 1 there is shown a spin stabilized carrier projectile 1 having a separated bottom 2 and ejecting submunition units 3. At its tail, submunition unit 3 has a planar or ballute-shaped [balloon+parachute] deceleration element 4 which initially is accommodated in a ring element 5 that can be separated from submunition unit 3 to then unfold. A ballute shaped deceleration element is described, for example, in Patent Application P 41 20 027.6 filed Jun. 18th, 1991, in Germany. After deceleration, for example to a predetermined number of revolutions per minute (RPM), ring element 5 and deceleration element 4 are severed from the submunition unit so that a secondary parachute (not shown) attached to the submunition unit can unfold.

In order to prevent deceleration element 4 from being deployed for a predetermined period of time under heavy spinning and to permit it to then open in a controlled manner, deceleration element 4 is provided, in accordance with the invention, with a textile package 6 as will be described with reference to FIGS. 2 to 5. Textile package 6 is composed of a circular textile disc 7 and crisscrossing, flexible, firm straps 8 that are arranged radially to disc 7. These straps are provided regularly in a number of at least three straps 8 composed of textile or plastic material or the like. Disc 7 and straps 8 may be connected in the center and/or in the edge region of disc 7 by means of seams or the like.

Straps 8 project from disc 7 and form loops 9 at their free ends which are tapered toward the free ends in that the projecting loop sections of straps 8 are partially folded over.

To fasten package 6 to submunition unit 3, holes 10 are provided in disc through which package 6 is fastened by means of appropriate fastening elements to ring element 5. Deceleration element 4 can be provided with holes at the same location as holes 10 in package 6 so that the two can be superposed and fastened to ring element 5 by way of screws or the like, and if necessary with the additional use of washers or a clamping ring.

Loops 9 accommodate a non-elastic, high-strength closing line 11 which is provided with two loop ends. In the closed state of package 6, closing line 11 is brought through all loops 9, pulling loops 9 together. One loop end is pushed through the other loop end and is secured by means of a textile or metal closure pin or plug 12. Alternatively, closing line 11 may be in the form of a ring which passes through loops 9 and which may be pulled for bringing together loops 9 for placing package 6 in the closed state. Of course, if closing line 11 is in the form of a ring, its approximate length must correspond at least to the circumference of package 6 in the deployed state, because otherwise, it could hamper deployment as will become apparent from the following.

Figure 3:
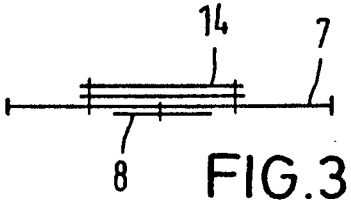
FIGS. 3 and 4 are sectional views along lines III—III and IV—IV, respectively, of FIG. 2.
Figure 4:
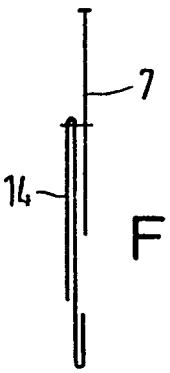
Figure 2:
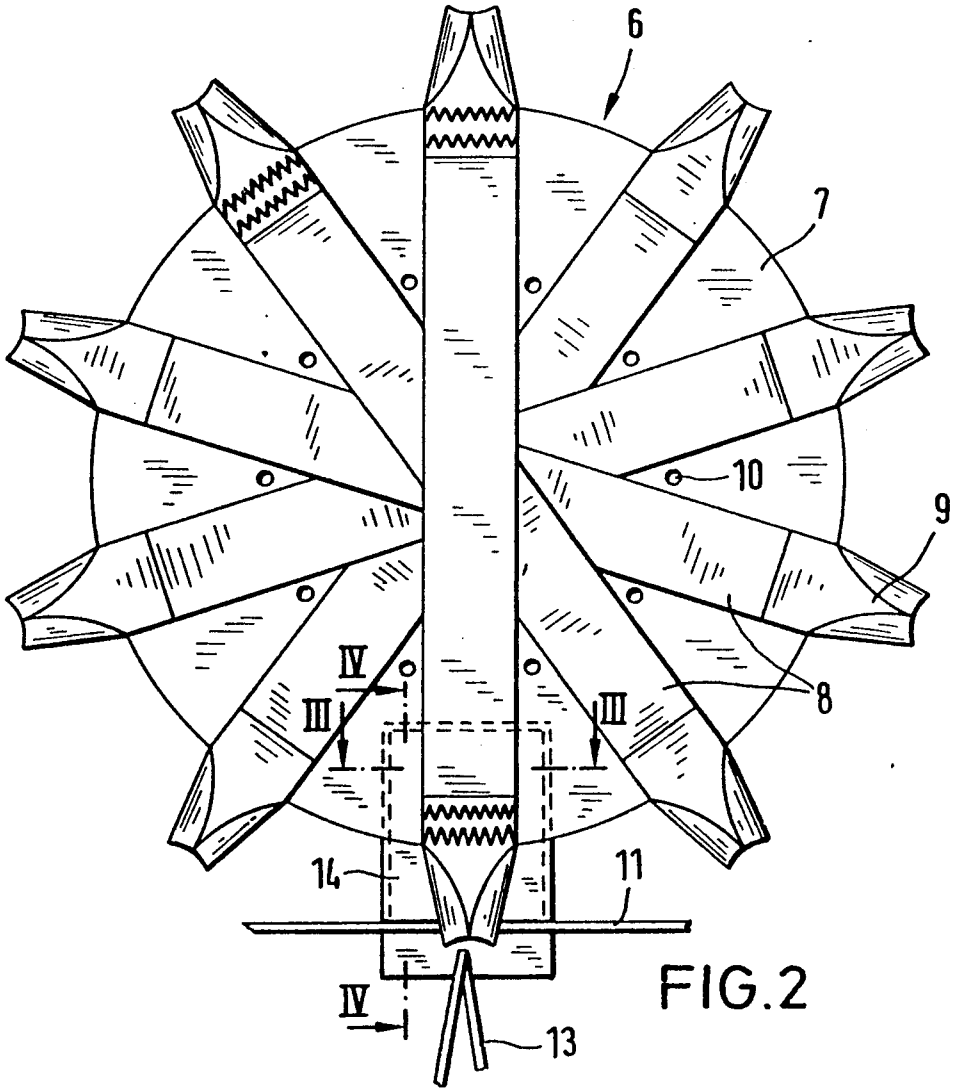
FIG. 2 is a plan view of a textile package for a deceleration element in accordance with an embodiment of the invention.
Figure 5:
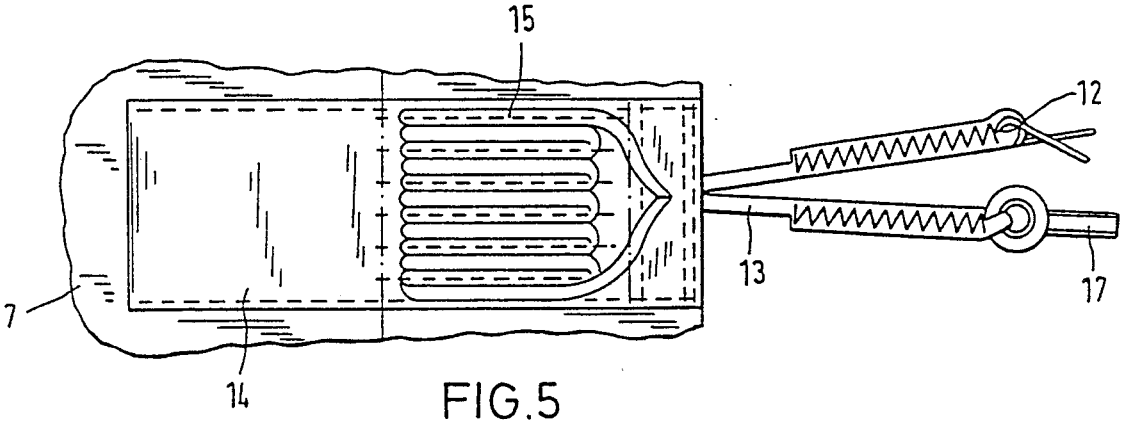
FIG. 5 is a sectional side view showing a cut away portion of FIG. 2.

An activation line 13 is provided which is either fastened on the interior, that is, the side of package 6 facing away from submunition unit 3, or folded into loops in a pocket 14 fastened to the interior of package 6 as shown in FIG. 5. FIGS. 3 and 4 are sectional views illustrating the construction of pocket 14. The arrangement of activation line 13 is such that controlled stretching of activation line 13 is ensured. This can be effected, for example, by passing it through an appropriate deceleration element or preferably in that activation line 13 is fastened in the form of a quasi-continuous seam 15, which forms a tear-away seam so as to ensure controlled stretching of activation line 13.

One end of activation line 13 is connected with closing pin 12 while the other end of activation line 13 is provided with a fastening means 17 (screw or the like) for being fastened to a further submunition unit 3 or to bottom 2 of carrier projectile 1 (See FIG. 5). After the submunition units are ejected from the rotating projectile carrier, separation of the submunition units from one another and the carrier bottom causes activation lines 13 to be stretched out. When an activation line 13 becomes fully stretched out, it pulls closing pin 12 and causes it to be released from closing line 11 so that package 6 can be deployed (opened) by centrifugal forces due to the rotation of the submunition unit.

Figure 6:
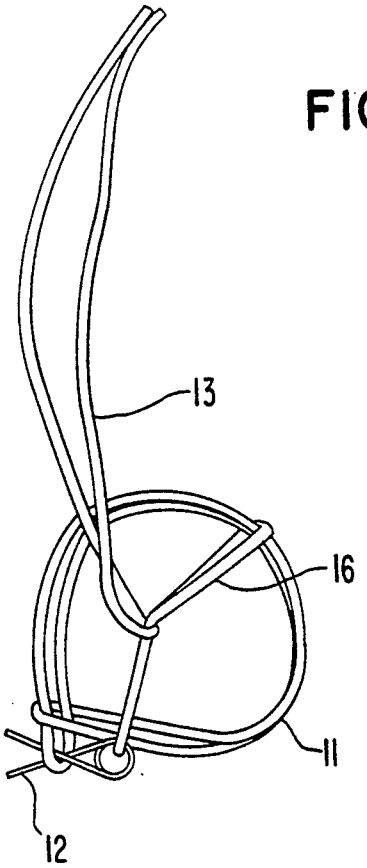
FIG. 6 shows the connection between closing pin and closing line.

If package 6 is to be opened at a relatively low RPM, a connecting line 16 of the appropriate length may be provided between the end of activation line 13 and closing line 11 as shown in FIG. 6.

The arrangement according to the invention has a number of advantages. The centrifugal forces are absorbed by the textile package 6 without the use of metal walls. Self-dynamics of activation line 13 are avoided and package 6 has a small mass and a small volume. It is easy to manufacture and manipulate. The deceleration device can be adapted to submunition unit 3 after being packaged.

The packaging of the deceleration device is effected under constant visual control. If, for example, a deceleration element 4 is employed that is provided with holes that correspond to holes 10 of textile package 6 as previously described, deceleration element 4 is fastened on a support together with package 6. An auxiliary packing line (not shown), having one end attached to closing line 11, is drawn through loops 9. The deceleration element is placed into package 6 in, for example, S-shaped segments or turns. Package 6 is closed by pulling the auxiliary packing line together, which pulls package 6 around the folded deceleration element. Then, closing line 11 is pulled through loops 9 by pulling the auxiliary packing line. Closing line 11 is then secured by means of closing pin 12, whereupon the auxiliary packing line is removed.

Obviously, numerous and additional modifications and variations of the present invention are possible in light of the above teachings. It is therefore to be understood that within the scope of the appended claims, the invention may be practiced otherwise than as specifically claimed.

What is claimed is:

1. In a deceleration device for a submunition unit that can be ejected from a spin stabilized carrier projectile, with the deceleration device including a deployable deceleration element, the improvement comprising:

a textile package for packaging the deceleration element in the deceleration device, comprising:

an essentially circular disc;

at least three straps connected and arranged radially to said disc, each said strap having a free end and a loop provided at said free end; and a closing line received through said loops for pulling said loops together to close said package about the deceleration element; and an activation line connected to said closing line and means for releasably connecting the activation line to said textile package, said activation line being arranged for releasing said closing line for allowing said package to open for deployment of the deceleration element after said activation line is released from said package by being stretched in a controlled manner.

2. A deceleration device as defined in claim 1, wherein said loops project from said disc and each said loop is tapered toward a respective one of the free ends.

3. A deceleration device as defined in claim 1, and further comprising a closing pin connected with said activation line and releasably securing said closing line for holding said loops together.

4. A deceleration device as defined in claim 1, wherein said means for releasably connecting said activation line to said textile package comprises a seam that forms a tear-away location.

5. A deceleration device as defined in claim 4, wherein said means for releasably connecting said activation line to said textile package includes a pocket at an interior location of said textile package in which said activation line is connected.

6. A deceleration device as defined in claim 1, further comprising a connecting line connected between said activation line and said closing line.

* * * * *

UNITED STATES PATENT AND TRADEMARK OFFICE

CERTIFICATE OF CORRECTION

PATENT NO. 5,233,126

DATED Aug. 3, 1993

INVENTOR(S) Vogt et al.

It is certified that error appears in the above-indentified patent and that said Letters Patent is hereby corrected as shown below:

On title page,

Item 75: Change inventors names to read:

Karl-Heinz VOGT, Essen
Heinz OLMSCHEID, Castrop-Rauxel, and
Klaus-Dietmar KARIUS, Jüchen, all of Germany Signed and Sealed this Twenty-second Day of March, 1994

*Attest:*

Bruce Lehman

BRUCE LEHMAN

*Attesting Officer*

*Commissioner of Patents and Trademarks*